United States Patent [19]

Gray

[11] 4,204,332

[45] May 27, 1980

[54] GOLF AID

[76] Inventor: Lewis L. Gray, 27255 Joppe Ave., Hemet, Calif. 92343

[21] Appl. No.: 929,818

[22] Filed: Jul. 31, 1978

[51] Int. Cl.[2] ..... A63B 69/36; A63B 53/00

[52] U.S. Cl. ..... 33/174 F; 273/182 R; 273/183 D

[58] Field of Search ..... 33/1 N, 174 F, 263, 33/289, 334; 273/163 R, 163 A, 183 D, 194 R, 162 R; 116/124 A, DIG. 6, 311, 320

[56] References Cited

U.S. PATENT DOCUMENTS

| | | | |
|---|---|---|---|
| 2,135,648 | 11/1938 | Stumpf | 273/162 R |
| 2,138,422 | 11/1938 | Halpin | 116/311 |
| 2,630,012 | 3/1953 | Walker | 273/162 R |
| 3,033,574 | 5/1962 | Partridge | 273/183 D |
| 3,118,678 | 1/1964 | Rohr | 273/163 A |
| 3,273,893 | 9/1965 | Duncan | 33/263 |
| 3,300,862 | 1/1967 | Judge | 33/263 |
| 3,323,367 | 6/1967 | Searle | 273/162 R |
| 3,951,415 | 4/1976 | Stuart | 273/163 A |

FOREIGN PATENT DOCUMENTS

| | | | |
|---|---|---|---|
| 361943 | 6/1962 | Switzerland | 116/320 |
| 407989 | 3/1934 | United Kingdom . | |

*Primary Examiner*—Richard R. Stearns
*Attorney, Agent, or Firm*—Harvey S. Hertz

[57] ABSTRACT

A golf aid for correcting the drive angle of a golf ball is secured to the shaft of a golf club. An indicator scale is mounted on the golf aid in a plane generally perpendicular to the axis of the shaft. A pointer is positioned adjacent to the scale for providing an indication of the amount of drive angle to be corrected. The pointer is manually moveable.

2 Claims, 4 Drawing Figures

GOLF AID

BACKGROUND OF THE INVENTION (1) Field of the Invention

The field of art to which the invention pertains includes the field of golf aids, particularly, with respect to an indicator mechanism which can be mounted on a golf club shaft for indicating a correction drive angle.

(2) Description of the Prior Art

While numerous golf aids have been provided which can determine, from a golfer's swing, the error in driving a golf ball, none of these devices provide a simple manually settable indication of the drive angle of a prior golf ball and, thus, the amount of angle correction which must be provided. Typically, it has been found that a golfer will periodically drive golf balls at a predetermined angle (hook or slice) from the norm. This results from a golfer's change of stance or golf club grip.

Known prior art includes U.S. Pat. Nos. 3,136,553; 2,501,277; 1,817,896; 3,194,563; 2,072,405; 3,323,367; and De. 171,586.

The present invention provides a novel indicator mechanism which can be mounted on a golf club shaft for providing an indication of adjustment necessary for a golfer to drive a golf ball at a predetermined angle. The system is based upon an indication of the prior angle which a golf ball has travelled, and the assumption that correction will eliminate an error angle.

SUMMARY OF THE INVENTION

A golf aid for correcting the drive angle of a golf ball is secured to the shaft of a golf club. An indicator scale is mounted on the golf aid in a plane generally perpendicular to the golf club shaft. A pointer is positioned adjacent to the scale for providing an indication of the amount of drive angle to be corrected. The pointer is manually moveable along the scale.

The advantages of this invention, both as to its construction and mode of operation, will be readily appreciated as the same becomes better understood by reference to the following detailed description when considered in connection with the accompanying drawings in which like reference numerals designate like parts throughout the figures.

DESCRIPTION OF THE PREFERRED EMBODIMENTS

Figure 1:
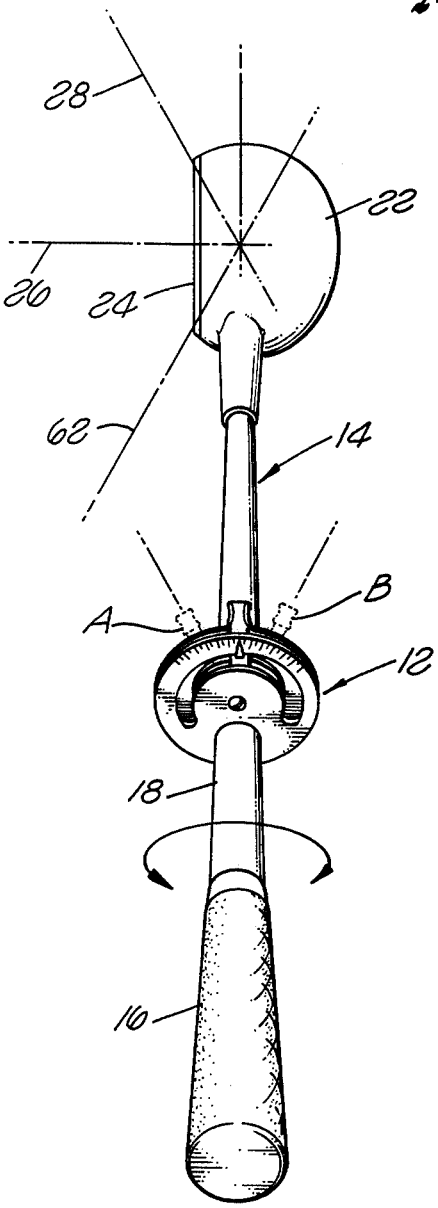
FIG. 1 is a perspective view of a golf club having the golf aid mounted thereon.

Referring now to the drawings, there is shown in FIG. 1 a golf aid 12 constructed in accordance with principles of the invention and shown mounted on a golf club 14. As is conventional the golf club includes a handle 16 mounted on one end of a shaft 18 and a driving head 22 at the other end of the shaft. As illustrated in FIG. 1, the golf club 14 is illustrated as a driver having a flat surface 24 formed on one side of the driver.

During driving, when the golf club is swung, golf club surface 24 causes the ball to travel along a plane generally perpendicular to the surface 24. Thus, when the golfer intends to drive the ball along a plane indicated by the dotted line 26 it is necessary that the golf ball be hit with the surface 24 perpendicular to the line 26. Should the golf ball instead travel along the line 28, which is at an acute angle respect to the line 26, it has been normally found that the golfer is striking the golf ball incorrectly (slice) and the golf aid of the present invention is designed to correct this error and return the drive of the golf ball to the position indicated by the line 26.

Figure 2:
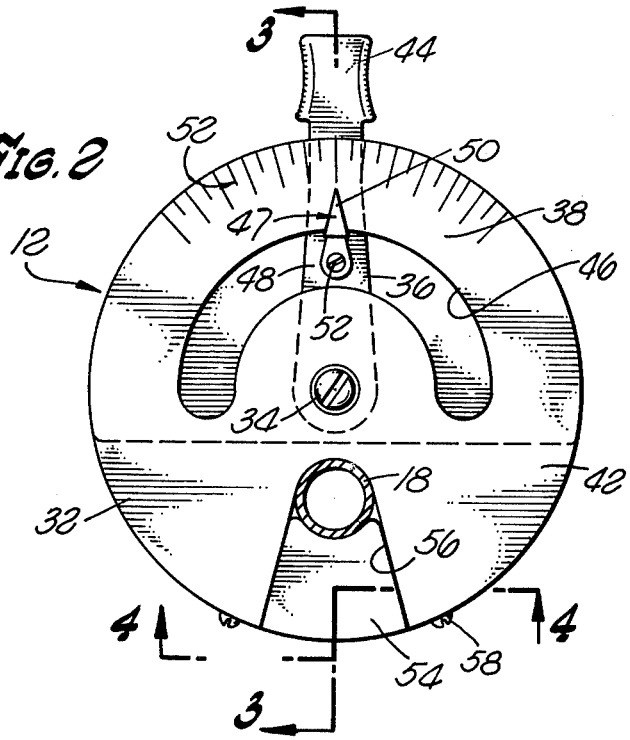
FIG. 2 is a plan view of the golf aid showing the golf club shaft cross section.
Figure 3:
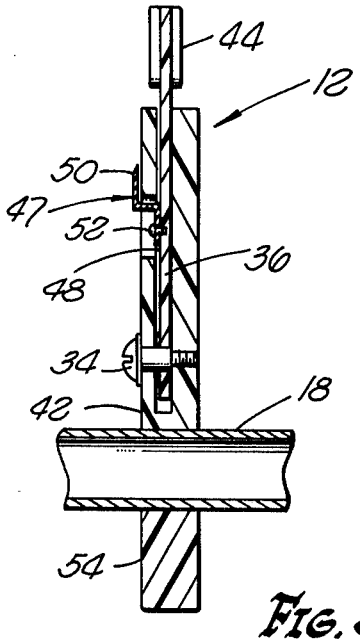
FIG. 3 is a cross sectional view of the golf aid of FIG. 2 taken along the line to 3—3 thereof.

Referring now to FIG. 2, the golf aid 12 of FIG. 1 shown in greater detail and as illustrated is mounted on the shaft 18 intermediate the driving head 22 and the handle 16. The golf aid is formed of a circular disc 32. At the center of the disc 32 a bolt 34 is positioned therein in a plane perpendicular to the disc. The bolt 34 outer surface forms a shaft and pivot point for an arm 36 which is moveable between an upper portion 38 and a lower portion 42 of the disc 32 as shown in FIG. 3.

The arm 36 extends beyond the outer periphery of the disc 32 and has a handle 44 formed on its outer end. The upper portion 38 and lower portion 42 of the disc are spaced apart so as to define a slot 46 wherein the arm 36 is moveable for approximately 180°. A pointer 47 is fastened on the top surface 48 of the arm 36 by means of a screw 52. The pointer 47 has a rasied free end 50 moveable above the outer surface of the disc upper portion 38. A scale 52 formed on the disc upper portion 38 top surface indicates the position of the arm 44 with respect to the golf club driving surface 24.

Figure 4:
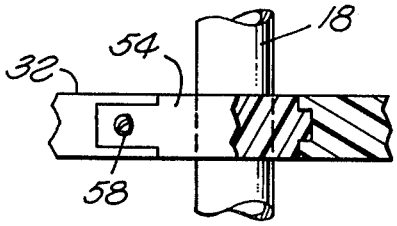
FIG. 4 is a cross sectional view of the golf aid of FIG. 2 taken along the line 4—4 thereof.

FIG. 4 illustrates the technique of securing the disc 32 to the golf club shaft 18. A generally truncated fastening plate 54 is removed from the disc 32 and its interior surface is curved so as to abut the outer edge of the golf club shaft 18. In addition, an opening 56 is formed in the disc directly below the bolt 34 opening so that the shaft can pass through the golf aid 12. After the shaft 18 is inserted into the opening 56, the fastening plate 54 is secured to the disc 32 by means of screws 58 fastening the golf club shaft 18, to the golf aid 12. In this initial fastened position, the pointer free end 50 should be at the zero position on the scale 52, and the arm 36 parallel to the driving head flat surface 24.

In operation, when the golf ball is driven (sliced) along the line 28 of FIG. 1 rather than along the line 26, the golfer is aware that his swing is off by an angle by which he can approximate as being the angle between the lines 26 and 28. The handle 44 is then moved to the left as shown in the first dotted position of the handle in the FIG. 1 and marked A. (The position A is an angle equivalent to but opposite to the angle between the lines 26 and 28). The golfer then rotates his grip or thumbs an amount indicated by this angle. During the next swing the golf ball should drive along the line 26. Alternatively, should the golf ball travel along the line 62 (hook) the golfer would rotate his hands or thumbs an amount equal to the position B shown in FIG. 1 with the handle in dotted lines. This in turn would cause the golf ball to once again travel along the line 26 rather than along the line 62.

I claim:

1. A golf aid formed of a disc mounted on a golf club shaft in a plane perpendicular to said shaft for correcting the drive angle of a golf ball comprising;

means for securing said golf aid to the shaft of said golf club;

said disc including a generally planar indicator means having a scale thereon; said golf aid being mounted on said golf club shaft intermediate the club handle and the club driving head, and in a plane generally perpendicular to the axis of said shaft, said shaft extending through a portion of said planar indicator means;

pointer means movable in said plane and positioned adjacent to the scale for providing an indication of the amount of drive angle to be corrected; and means for manually moving the pointer means.

2. A golf aid in accordance with claim 1 wherein a handle is secured to said disc, said handle having said pointer means secured thereto, said handle and said pointer means being moveable in a plane parallel to said disc.

* * * * *